US009179781B2

(12) United States Patent
Melsen

(10) Patent No.: US 9,179,781 B2
(45) Date of Patent: Nov. 10, 2015

(54) METHOD FOR MANUFACTURING A MATTRESS OR A MATTRESS-PILLOW COMBINATION AND COMPONENTS USED THEREIN

(75) Inventor: Gert Bart A. Melsen, Schilde (BE)

(73) Assignee: OLLIN, BESLOTEN VENNOOTSCHAP MET BEPERKTE AANSPRAKELIJKHEID, Antwerp (BE)

( * ) Notice: Subject to any disclaimer, the term of this patent is extended or adjusted under 35 U.S.C. 154(b) by 589 days.

(21) Appl. No.: 13/349,108

(22) Filed: Jan. 12, 2012

(65) Prior Publication Data

US 2012/0192357 A1 Aug. 2, 2012

(30) Foreign Application Priority Data

Jan. 28, 2011 (BE) ..... 2011/0050

(51) Int. Cl.

| | |
|---|---|
| ***A47C 27/14*** | (2006.01) |
| ***A47C 27/15*** | (2006.01) |
| ***A47C 31/12*** | (2006.01) |
| *A61G 7/057* | (2006.01) |

(52) U.S. Cl.

CPC ..... *A47C 27/148* (2013.01); *A47C 27/14* (2013.01); *A47C 27/15* (2013.01); *A47C 31/123* (2013.01); *A61G 7/05715* (2013.01); *Y10S 5/935* (2013.01); *Y10T 29/481* (2015.01)

(58) Field of Classification Search

CPC .... A47C 27/15; A47C 27/148; A47C 27/001; A47C 27/144; A47C 27/14; A47C 27/142; A47C 27/05; A47C 27/056; A47C 27/053; A61G 7/05715; Y10S 5/935; Y10S 5/953; Y10T 29/481

USPC ..... 5/722, 728, 727, 636, 640, 697

See application file for complete search history.

(56) References Cited

U.S. PATENT DOCUMENTS

| | | | |
|---|---|---|---|
| 2003/0221261 | A1 | 12/2003 | Torbet et al. |
| 2005/0076446 | A1 | 4/2005 | Fogg |
| 2010/0223734 | A1 | 9/2010 | Oh |

(Continued)

FOREIGN PATENT DOCUMENTS

| | | |
|---|---|---|
| DE | 29617420 | 1/1997 |
| DE | 202006001350 | 4/2006 |

(Continued)

OTHER PUBLICATIONS

Foreign Document FR 2866222 Translation.*

(Continued)

*Primary Examiner* — Peter M Cuomo
*Assistant Examiner* — Brittany Wilson
(74) *Attorney, Agent, or Firm* — Houston & Associates, LLP

(57) ABSTRACT

Method to manufacture a personalized mattress (1) from a basic part (2) with a recess (2) and inserts (3, 4, 5), which comprises the following steps: determination of the anthropometric data of a person; determination of the optimum distances over which the mattress (1) has to be deformed in a number of positions so that the spine of the person in this position has the same shape, insofar possible, as when the person is standing upright; determination of the deformation characteristics that a mattress (1) must have at these positions; selection of inserts (3, 4, 5); fitting of the inserts (3, 4, 5) in the basic part (2).

7 Claims, 3 Drawing Sheets

(56) References Cited

U.S. PATENT DOCUMENTS

| | | | | |
|---|---|---|---|---|
| 2010/0313359 | A1* | 12/2010 | Scott et al. | 5/655.3 |
| 2011/0099722 | A1* | 5/2011 | Moret et al. | 5/701 |

FOREIGN PATENT DOCUMENTS

| | | |
|---|---|---|
| DE | 202007000847 | 5/2008 |
| FR | 2866222 | 8/2005 |
| WO | 8102384 | 9/1981 |
| WO | 03084368 | 10/2003 |

OTHER PUBLICATIONS

EPO Search Report in Belgium Patent Application No. BE 201100050, Aug. 18, 2011.

* cited by examiner

METHOD FOR MANUFACTURING A MATTRESS OR A MATTRESS-PILLOW COMBINATION AND COMPONENTS USED THEREIN

BACKGROUND OF THE INVENTION

1. Field of the Invention

The present invention relates to a method for manufacturing a mattress or a mattress-pillow combination and components used therein.

2. Related Art

More specifically it concerns mattresses and mattress-pillow combinations that are adapted to a person, so that the person lies more comfortably and/or has more restful sleep and/or in order to reduce or avoid physical complaints relating to body posture and/or the presence of pressure points or overloads.

Mattresses are already known that are made up of a mattress core and a comfort layer, whereby the comfort layer on the lying side is divided into a number of comfort zones with different hardnesses in order to support the body of the person lying on the mattress as well as possible.

In known mattresses these comfort zones can, for example, be in the zone of the head, shoulders, lumbar region, hips, thighs, legs or feet.

Such a mattress is known from DE 20.2006.001.350 in which the position of the different zones can be adjusted to the height of the person.

It is hereby only possible to adapt the positions of the harder and softer zones to the height of the person, but it is not possible to adjust the hardness of the zones for the person, they remain the same for everybody.

Mattresses in which the hardnesses of the various zones are adjusted for the mattress user are also known.

These mattresses are traditionally made by the people for whom they are being made lying on a number of test mattresses with adjustable comfort zones, and a personalised mattress is made on the basis of their preferences, by making some comfort zones harder and some comfort zones softer.

This has the disadvantage that the mattress cannot be adapted to the varying requirements of the person over time.

For example during the lifetime of the mattress, the weight of the person may change, such that the comfort zones are no longer correctly situated with respect to the body.

As a result of these bodily changes, the mattress provides inadequate support for the body, which can result in many physical complaints and sleeplessness.

This method also has the disadvantage that while a mattress that feels comfortable is obtained, this method certainly does not guarantee a healthy, restful and overload-avoiding sleeping position.

A variant of such a method is described in WO 03/084368, in which on the basis of a multitude of data, to be measured by a person himself, the hardnesses of the comfort zones of the mattress are individualised by providing the mattress with sections of different hardnesses. In this way the aim is to create a healthy and comfortable sleeping position for the person.

However, it is not clear here how to determine what hardness the pieces have to have. Firstly, it is not clear what a healthy and comfortable sleeping position means in terms of body posture, and thus what characterises such a healthy and comfortable sleeping position, in brief what is the objective to be achieved.

It is also not clear what the procedure is to adapt the desired hardnesses of the individual pieces so that this objective is achieved.

A further disadvantage is that the comfort feeling experienced by the person not only depends on the mattress, but also on the base on which the mattress lies, for example the elastic properties of the slats on which the mattress lies.

This thus means that if a person wants a mattress for a different type of bed-base format than the one used for the test lying, the results will be unreliable.

It is known from DE 296.17.420 that the hardness of a pillow is important for a healthy sleeping position. This document thus published a pillow whose hardness can be adjusted.

Just as with the mattresses described above, however, it is not clear how the properties of such a pillow have to be selected to achieve the desired result, certainly not in combination with a mattress.

BRIEF SUMMARY OF THE INVENTION

The purpose of the present invention is to provide a solution to at least one of the aforementioned and other disadvantages, by providing a method to manufacture a mattress that is adapted to a specific person, whereby it is manufactured from a basic part provided with a recess and selectively chosen inserts that fit in the recess, and which comprises the following steps: determination of the anthropometric data of the person, at least insofar they relate to the zone from the shoulders to the hips of the person; determination of the optimum distances over which the mattress has to be deformed locally in a number of positions between the hips and shoulders of the person when the person is lying on it sideways so that the shape of the spine of the person in this position corresponds as much as possible to the shape of the spine when the person is standing upright; determination of the deformation characteristics that a mattress must have at these positions, so that the mattress at least approximately deforms over the determined optimum distances when the person is lying on the mattress; selection of the inserts to be used from a list or stock of possible inserts, which in combination with the basic part at least approximately have the desired deformation characteristics at the positions; fitting of the selected inserts in the basic part at the aforementioned positions.

This has the advantage that it is an easy, reliable and objective method for making a personalised mattress.

Through the attention paid to the shape of the spine, more specifically that the shapes match one another in the standing and lying position, this also has the advantage that a personalised mattress is obtained which, due to the optimum shape of the spine also being maintained during sleep, ensures healthy, restful sleep.

Another advantage is that such a mattress can be easily adjusted to a changed body weight or changed physique, for example due to the ageing, deformation, illness or an accident of the person, simply by adjusting the inserts.

A further advantage is that thanks to this method, the mattress can be easily adapted to provide an optimum result together with the base that the person wishes to use.

Preferably the optimum distances over which the mattress has to be deformed at a number of positions are determined by comparing the measured anthropometric data in an expert system to the anthropometric data from a large number of test subjects whose anthropometric data over at least the zone from the shoulder to the hips, as well as the distance over which a mattress has to be deformed at these positions, have been experimentally determined, to ensure that the shape of their spine when lying sideways on the mattress is the same as the shape of their spine in an upright position.

This has the advantage that the suitability of the mattress for the person is increased.

In a practical embodiment, the number of positions and the number of inserts is three.

Preferably a position and an insert relate to the shoulders of the person, a position and an insert relate to the waist of the person, and a position and an insert relate to hips of the person.

In this way, a very good result is easily achieved with only a limited number of positions and inserts.

According to a preferred characteristic, the width of the inserts is adjusted to the height of the person.

This increases the flexibility in the manufacture of an optimum mattress, as it can be adjusted to the height of the person.

In a specific embodiment of the method, a mattress-pillow combination is manufactured that comprises a pillow and a mattress, whereby the mattress is manufactured by means of the method described above, whereby the anthropometric data of the person are determined from the head to at least the hips of the person, and whereby the pillow is manufactured from a basic pillow part and any raising pieces, whereby the desired height of the pillow is also determined from the anthropometric data of the person in order to ensure that the shape of the spine of the person, when lying sideways, corresponds as much as possible to the shape of the spine when the person is standing upright, and that the basic pillow part, depending on the determined desired height, is raised with a number of raising pieces if need be.

The invention also comprises a basic part to manufacture a mattress according to the method according to the invention, which comprises a top comfort layer, whereby a recess is provided in the top side of the top comfort layer, at a position corresponding to the zone from the shoulder to the hips of a person lying on a mattress, and whereby the recess at least covers the bulk of the width of the mattress.

The invention also comprises a mattress manufactured according to the above method and a mattress-pillow combination manufactured according to the above method.

DESCRIPTION OF THE DRAWINGS

With the intention of better showing the characteristics of the invention, a few preferred applications of the method for manufacturing the mattress according to the invention are described hereinafter by way of an example, without any limiting nature, with reference to the accompanying drawings, wherein.

DETAILED DESCRIPTION OF PREFERRED EMBODIMENTS OF THE INVENTION

Figure 1:
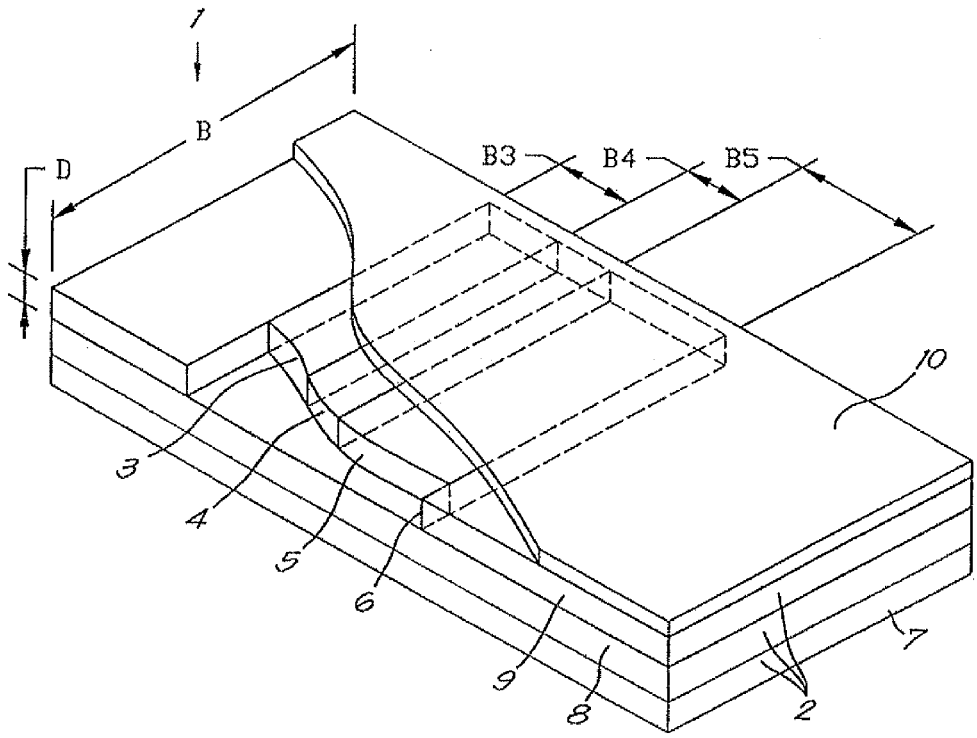
FIG. 1 schematically shows in perspective a mattress according to the invention.
Figure 2:
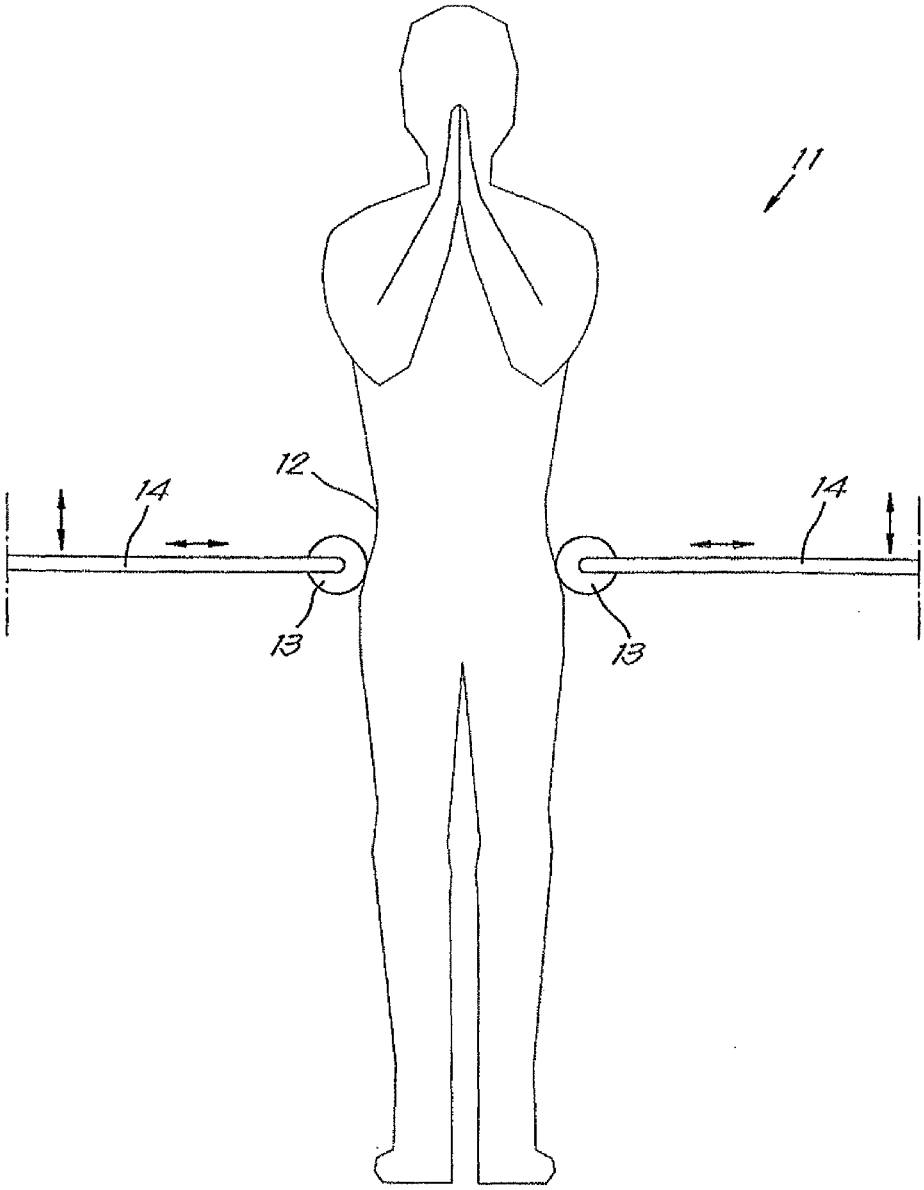
FIG. 2 schematically shows a step in the method according to the invention.

A mattress 1 that is adapted to a specific person can be made from a basic part 2 and inserts 3, 4, 5 that are put in one recess 6 in the mattress.

Preferably the basic part 2 is formed from bottom to top by a bottom comfort layer 7, formed by a soft but sturdy material, for example a latex foam or another material that is usually used for comfort layers of mattresses, an elastic layer 8, for example formed by a set of springs that are compressible in a vertical direction, and a top comfort layer 9, made from a similar material to the bottom comfort layer 7.

The set of springs in the elastic layer 8 is normally surrounded by a relatively sturdy foam frame, that serves to keep the springs in their place. Such a frame must be of relatively hard foam to allow people to sit on the edge of a mattress, without the edge deforming too much.

Normally speaking such an elastic layer 8 has springs of different elasticity to obtain different spring characteristics over the surface of a mattress, somewhat in line with an average body.

In zones with springs that deform very easily, such as can occur in the shoulder zone for example, the springs can deform substantially more easily than the foam frame, such that the foam frame interferes with the desired deformation of the springs.

In order to reduce this, the foam frame can be made softer locally in these zones, for example by providing the foam frame with holes, such that the sturdiness of the foam is reduced.

An overlay mattress 10 can be provided as an option as a supplement to the basic part. This is a relatively thin, soft layer, intended to give a comfortable soft feeling for the user.

The combination of the elastic layer 8 and the comfort layers 7, 9 is enclosed by an inner cover that is shown in FIG. 1.

The recess 6 is present in the top comfort layer 9, and runs over the entire width B of the basic part 2, and is present in the zone of the basic part 2 that corresponds to the region from the shoulders to the hips of the person. The recess 6 has a depth D.

The inserts 3, 4 and 5 have a thickness that corresponds to the depth D of the recess and widths B3, B4 and B5. The inserts 3, 4 and 5 can be made from a multitude of materials, such as but not limited to leaves or fibres of the Abaca plant, Fossfill, latex foam of different hardnesses, palm leaves or fibres, PET/latex foam mixtures, different qualities of polyurethane foam, possibly made from soya polyols, fibres from recycled PET, sisal, taillok, flax, wool, whether or not mixed with cotton or camelhair.

Preferably the materials used for the inserts 3, 4 and 5 are of an ecological nature, which in this context means they originate from recycled materials, materials that have no or a low economic value as a by-product from another industry, or materials originating from sustainable agriculture.

The materials from which the inserts 3, 4 and 5 can be made, and thus the list from which the inserts 3, 4, 5 can be selected, are characterised beforehand by means of their force-displacement curve, which indicates how much force is needed to give a standard piece of the material a series of imposed deformations.

Parameters can be derived from such a curve via standard materials science methods that describe a material, such as stiffness, modulus of elasticity and any hysteresis behaviour, which means elasticity that is different for a load increase compared to a load decrease.

In order to make a mattress 1 that is adapted to a specific person, the anthropometric data of the person are first determined. These anthropometric data describe the precise dimensions of the body and the weight distribution over the body. The anthropometric data are determined in the following way:

The total weight of the person is first determined by weighing.

Figure 3:
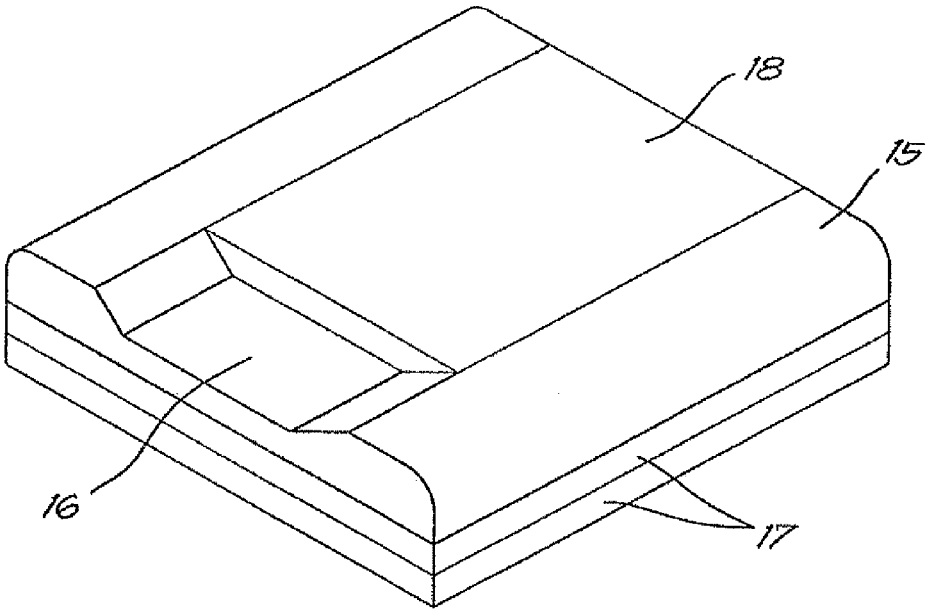
FIG. 3 shows a component of the mattress-pillow combination according to the invention.

Then using a roller system 11, as shown in FIG. 3, the sides 12 and the back of the person are traced, at least in the zone from the shoulders to the hips. The person stands with his hands in front of his face and the forearms folded together.

This roller system 11 primarily consists of rollers 13 and supporting arms 14 that move vertically along the body, the resulting horizontal displacement of which is recorded, whereby an outline of the relevant part of the body of the person is generated.

Alternatively other systems can be used here to determine the outlines of a body, such as an optical system for example.

A weight distribution over the body is then determined by a computer system on the basis of the measured total weight and the measured outlines of the person.

Then on the basis of the measured anthropometric data, target values are determined for the optimum compression distance in the shoulder, waist and hip zones. These values for the optimum compression distance indicate how far a mattress 1 has to be compressed in the shoulder, waist and hip zones, so that the spine of the person lying sideways on a mattress has the same shape as in an upright position.

These target values are also determined by means of an expert system that contains experimental data from test subjects whose anthropometric data have been determined, preferably but not necessarily with the above-mentioned method, and for whom the compression distance that a mattress 1 has to have in the said zones for these trial subjects has been experimentally determined, so that their spine has the same shape when lying sideways as in the upright position.

Then, on the basis of the known deformation characteristics of the basic part 2 and the known deformation characteristics of the inserts 3, 4, 5, the material from which the inserts 3, 4, 5 have to be selected can be calculated by a computer model in order to make a mattress 1 for the person, such that when this person is lying sideways on the mattress 1, the degree of compression in the shoulder, waist and hip zones is equal to the target values.

Hereby account can also be taken of the deformation characteristics of the bed-base, for example a slat base or box spring base on which the mattress 1 will be placed in the future, by also using the deformation characteristics of this base in the computer model.

On the basis of the body height of the person, the widths B3, B4, B5 of the inserts 3, 4, 5 can be adjusted to better ensure that an insert 3, 4, 5 intended for a certain zone of the mattress 1, for example an insert 5 for the hip zone, is indeed loaded by the relevant part of the body of the person.

The inserts 3, 4, 5 are now taken from a stock or specifically made or adapted, each provided with a cover and place in the recess.

To this end the recess and cover are provided with pieces of hook and loop fasteners, but other fastening means are also possible.

An outer cover is now provided around the entire basic part 2 with inserts 3, 4, 5 to complete the mattress 1 adapted to the person.

Alternatively an overlay mattress 10 can be placed on the basic part 2 with inserts 3, 4, 5. If an overlay mattress 10 is used, an outer cover is not normally required.

Optionally, to manufacture a mattress-pillow combination according to the invention, the measurement of the anthropometric data can be extended to the head of the person, whereby the desired height of the head above the mattress 1 can also be determined, to obtain, as before, a position of the spine that is the same in both the lying and standing position.

A basic pillow part 15, provided with a recess 16, as a supplement to the individualised mattress, manufactured as set out above, can now be raised by means of raising pieces 17 depending on the result of the determination of the desired height of the head. The result of the determination can also mean that the height of the basic pillow part 15 is optimum for the person and that it is not necessary to raise it.

Depending on the desires of the person, the recess 16 in the basic pillow part 15 can be provided with a filling piece 18 which, depending on the desire of the customer, has specific comfort properties, for example it feels harder or softer, or warmer or cooler through a lower or higher coefficient of thermal conductivity.

It is not only possible to provide the top comfort layer 9 with a recess 6 and inserts 3, 4, 5, but also to do this with the bottom comfort layer 7, according to a similar method. Hereby the resulting mattress 1 can be used on both sides and thus turned around from time to time.

The construction of the basic part 2 in layers as described above, and the use of an overlay mattress 10, is only one possible embodiment. The structure of a mattress can also be less emphatically layered, a mattress or basic part can also be built from more than the said number of layers, and the comfort layers and the overlay mattress can be entirely or partially integrated together, or they can take over each other's function. It is thus also possible in the framework of the invention that there is a comfort layer, with an overlay mattress on it, and that the overlay mattress is then provided with a recess for the inserts. In this case the overlay mattress is also seen as being a comfort layer.

It is possible that the overlay mattress and a comfort layer are provided with a recess, whereby the inserts extend over more than one layer of the mattress.

The present invention is by no means limited to the embodiments described as an example and shown in the drawings, but such a method, the components used, mattress and mattress-pillow combination can be realised in all kinds of variants, without departing from the scope of the invention.

The invention claimed is:

1. A method to manufacture a mattress that is adapted to a specific person, and that is manufactured from a base part provided with a recess and three selectively chosen inserts that fit in the recess comprising the steps:

obtaining anthropometric data of a person by measuring the total weight of the person by weighing, obtaining the shape of the side and back outlines of the body of the person in a standing position by rolling rollers over the side and back of the body, and wherein the rollers are connected to a system that measures the horizontal displacement of the rollers, and then determining the weight distribution by means of an arithmetic method that attributes a part of the measured weight to a part of the body on the basis of the measured outlines, at least insofar the data relate to the zone from the shoulders to the hips of the person;

determining the optimum distances over which the mattress has to be deformed at the shoulder, waist and hip zones of the person when the person is lying on it sideways so that the shape of the spine of the person lying on the mattress corresponds as much as possible to the shape of the spine when the person is standing upright;

determining the deformation characteristics that a mattress must have at these positions, so that the mattress at least approximately minimally deforms over the determined optimum distances when the person is lying on the mattress;

selecting inserts for the shoulder, waist and hip zones to be used from a list or stock of possible inserts, which in combination with the base part at least minimally approximately have the desired deformation characteristics at said positions;

and fitting the selected inserts in recesses provided in the base part at said positions.

2. Method according to claim 1, wherein each insert is kept in the desired position in the recess by hook and loop fasteners.

3. Method for making a mattress-pillow combination that comprises a pillow and mattress, said mattress being manufactured by the method recited in claim 1, wherein the anthropometric data of the person are determined from the head to at least the hips of the person; the pillow is manufactured from a basic pillow part, wherein the basic pillow part is provided with a recess for a filling piece, and on the basis of the individual desires of the person relating to comfort, a filling piece with certain properties is elected and placed in the recess, and raising pieces as needed; the desired height of the pillow is also determined from the anthropometric data of the person to ensure that the shape of the spine of the person when lying sideways corresponds as much as possible to the shape of the spine when the person is standing upright and the basic pillow part, depending on the determined desired height, is raised by a number of raising pieces.

4. Mattress-pillow combination manufactured by the method recited in claim 3.

5. A method to manufacture a mattress that is adapted to a specific person, and that is manufactured from a base part provided with a recess and three selectively chosen inserts that fit in the recess comprising the steps:

obtaining anthropometric data of a person, at least insofar the data relate to the zone from the shoulders to the hips of the person;

determining the optimum distances over which the mattress has to be deformed at the shoulder, waist and hip zones of the person when the person is lying on it sideways so that the shape of the spine of the person lying on the mattress corresponds as much as possible to the shape of the spine when the person is standing upright;

determining the deformation characteristics that a mattress must have at these positions, so that the mattress at least approximately minimally deforms over the determined optimum distances when the person is lying on the mattress;

selecting inserts for the shoulder, waist and hip zones to be used from a list or stock of possible inserts, which in combination with the base part at least minimally approximately have the desired deformation characteristics at said positions;

and fitting the selected inserts in recesses provided in the base part at said positions, wherein each insert is kept in the desired position in the recess by hook and loop fasteners.

6. A method to manufacture a mattress-pillow combination that is adapted to a specific person, and that is manufactured from a base part provided with a recess and three selectively chosen inserts that fit in the recess comprising the steps:

obtaining anthropometric data of a person, at least insofar the data relate to the zone from the shoulders to the hips of the person;

determining the optimum distances over which the mattress has to be deformed at the shoulder, waist and hip zones of the person when the person is lying on it sideways so that the shape of the spine of the person lying on the mattress corresponds as much as possible to the shape of the spine when the person is standing upright;

determining the deformation characteristics that a mattress must have at these positions, so that the mattress at least approximately minimally deforms over the determined optimum distances when the person is lying on the mattress;

selecting inserts for the shoulder, waist and hip zones to be used from a list or stock of possible inserts, which in combination with the base part at least minimally approximately have the desired deformation characteristics at said positions;

fitting the selected inserts in recesses provided in the base part at said positions; and manufacturing a pillow from a basic pillow part and raising pieces as needed; the desired height of the pillow is also determined from the anthropometric data of the person to ensure that the shape of the spine of the person when lying sideways corresponds as much as possible to the shape of the spine when the person is standing upright and the basic pillow part, depending on the determined desired height, is raised by a number of raising pieces.

7. Mattress-pillow combination manufactured by the method recited in claim 6.

* * * * *